United States Patent [19]

Sato et al.

[11] Patent Number: 5,003,901

[45] Date of Patent: Apr. 2, 1991

[54] FEEDING RATE ADJUSTING UNIT OF A SEWING MACHINE

[75] Inventors: Shuichi Sato; Yoshiharu Kobayashi, both of Utsunomiya, Japan

[73] Assignee: SSMC Inc., Edison, N.J.

[21] Appl. No.: 374,820

[22] Filed: Jul. 3, 1989

[30] Foreign Application Priority Data

Aug. 1, 1988 [JP] Japan ..... 63-101094[U]

[51] Int. Cl.[5] ..... D05B 27/22

[52] U.S. Cl. ..... 112/316; 112/317

[58] Field of Search ..... 112/315, 316, 317, 462

[56] References Cited

U.S. PATENT DOCUMENTS 1,118,271 11/1914 Diehl et al. ..... 112/317

*Primary Examiner*—Werner H. Schroeder

*Assistant Examiner*—Paul C. Lewis

*Attorney, Agent, or Firm*—Theodore Jay

[57] ABSTRACT

A feeding adjusting dial has at an inner circumferential surface thereof a plurality of teeth fixed to a stopper defined in the body of an arm of the sewing machine at both sides of the feeding rate adjusting shaft meshes with one of the plurality of teeth of the feeding rate adjusting dial. The feeding rate adjusting shaft is screwed into the body of the arm at a portion thereof and has a tip end thereof brought into contact with a cam surface of a feeding adjusting cam. The feeding adjusting cam is connected to a feeding adjusting table via a link. The feeding rate adjusting shaft comprises a first member, a second member and an elastic coupling for connecting the first and second members. One of the first and second members is screwed into the body of the arm of the sewing machine.

4 Claims, 3 Drawing Sheets

FEEDING RATE ADJUSTING UNIT OF A SEWING MACHINE

BACKGROUND OF THE INVENTION

1. Field of the Invention:

The present invention relates to a unit for adjusting the feeding rate of a sewing machine.

2. Description of the Prior Art:

A prior art unit for adjusting the feeding rate of a sewing machine will be described with reference to FIGS. 4 and 5.

The feeding rate adjusting unit comprises a body 1 of an arm of the sewing machine. A feeding rate adjusting shaft 2' is attached to a side of the body 1, is composed of a base 2'a, a screw portion 2'b having a diameter less than the diameter of the base 2'a and threaded into the body 1, and a tip end 2'c to which is moved into contact with a cam surface 7a of a feeding cam 7 (described later). A feeding rate adjusting dial 3 is secured by set screw 4 into an end of the base 2'a of the feeding rate adjusting unit 2'. Dial 3 is provided with a plurality of teeth 3a defined on its inner circumferential surface. A stopper 6 is positioned in a stopper receiver 1a defined in the side of the body 1. A compressed spiral spring 5 is housed in a bottom of the stopper receiver 1a and urges the stopper 6 to mesh with one of the teeth 3a. The feeding adjusting cam 7 has one end having a cam surface 7a provided with a normal feeding control surface and a reverse feeding control surface. The cam 7 has a central portion swingably supported by a cam shaft 8. The other end of cam 7 is connected pivotally to an end of a link 9. Link 9 has an opposite end connected to a feeding adjusting table 10. The feeding adjusting table 10 capable of being turned about a support shaft 11 to be inclined whereby the feeding rate of the sewn cloth is adjusted on the basis of an angle of inclination. A tension spring 12 normally urges the feeding adjusting cam 7 about the cam shaft 8 in the clockwise direction for permitting the tip end surface 2'c of the feeding rate adjusting shaft 2 to be brought into contact with a lower half portion or the normal feeding control surface of the cam surface 7a so that the feeding adjusting table 10 can feed the sewn cloth in the normal feeding direction.

Accordingly, turning the feeding rate adjusting dial 3 varies the distance or amount of moving into or away from the inside of the inner side of the body 1. Locking the feeding adjusting dial 3 at the inner side of the body 1 thereby varies the position of contact of the tip end surface 2c of the feeding rate adjusting shaft with the lower half portion of the cam surface 7a. The inclination angle of the feeding adjusting table 10 connected to the link 9 relative to the shaft 11 is varied to adjust the feeding rate of the sewn cloth in the normal feeding direction.

In case of a backtracking operation, a magnetic solenoid (not shown) is operated by an instruction from a controller (not shown) of the sewing machine whereby first, the shaft 11 is turned at high speed to quickly push the link 9 upward against a tension force of the tension spring 12; secondly, the feeding rate adjusting cam 7 is turned counterclockwise, namely, in the direction of the arrow B; thirdly, the upper half of the cam surface 7a as the reverse feeding control surface strikes heavily and moves into contact with the tip end surface 2'c of the feeding rate adjusting shaft.

However, when the magnetic solenoid is operated to carry out the backtacking operation, the feeding adjusting cam 7 is turned to permit the upper half of the cam surface 7a to momentarily strike the tip end surface 2'c of the feeding rate adjusting shaft. At this point, metallic impact sound is produced which causes operators to become nervous. If the feeding rate adjusting dial 3 is increased in size to improve the working efficiency, a vibrating sound of the feeding adjustment dial 3 is magnified also adversely affecting the operator.

SUMMARY OF THE INVENTION

The present invention overcomes the above/mentioned problems of the prior art feeding rate adjusting unit.

It is therefore an object of the present invention to provide a feeding rate unit for adjusting the sewing machine which resists transmission of the metallic sound to the outside, thus improving the working efficiency.

It is another object of the present invention to provide a unit for adjusting the feeding rate of a sewing machine which enables the size of the feeding rate adjusting dial to be increased.

To achieve the above objects, the unit for adjusting the feeding rate of a sewing machine employs a feeding rate adjusting shaft screwed into a body of an arm of a sewing machine. A feeding rate adjusting shaft has a tip end at one end thereof. A feeding rate adjusting dial is secured to one end of the feeding rate adjusting shaft and has a plurality of teeth at the inner circumferential surface thereof. A stopper is positioned in a stopper receiver defined in the side of the body of the arm. A compressed spiral spring is housed in a bottom of the stopper receiver for urging the stopper so that the stopper can mesh with one of the teeth of the feeding rate adjusting dial. A feeding adjusting cam has one end with a cam surface provided with a normal feeding control surface and a reverse feeding control surface. The tip end surface of the feeding rate adjusting shaft is moved into contact with the cam surface thereby varying an inclination angle of a feeding adjusting table via a link connected between the feeding adjusting cam and the feeding adjusting table so that the feeding rate can be adjusted in the normal or reverse feeding operation. The feeding adjusting shaft includes a dial fixing table fixed to the fixing adjusting dial and a cam contact member. An elastic member connects the dial fixing table and the cam contact member. Either the dial fixing table or the cam contact member has a screw portion at an outer peripheral surface which is inserted into a portion of the body.

The above and other objects, features and advantages of the present invention will become more apparent from the following description taken in conjunction with the accompanying drawings.

DESCRIPTION OF THE PREFERRED EMBODIMENT

A unit for adjusting the feeding rate of a sewing machine according to a first embodiment of the present invention will be described with reference to FIG. 1.

Figure 1:
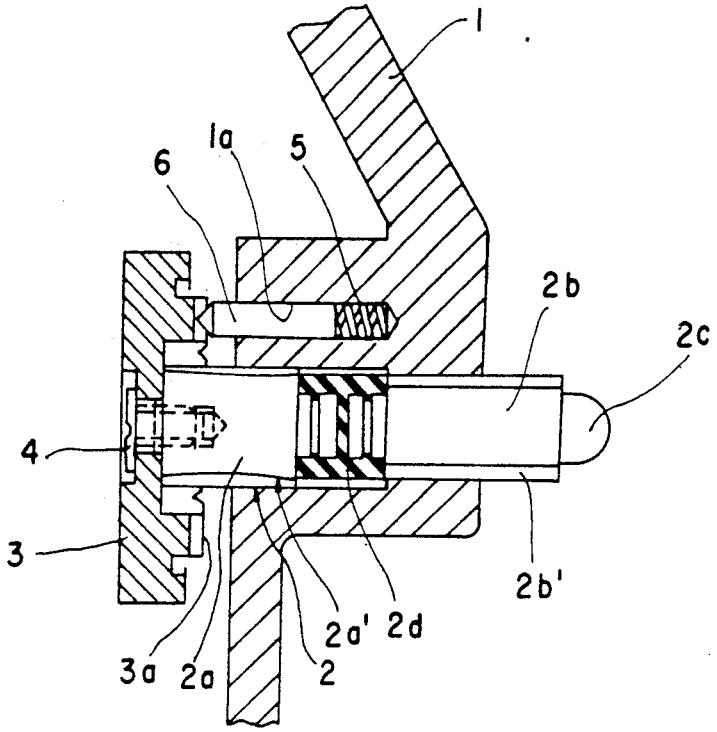
FIG. 1 is a cross sectional view of a feeding rate adjusting shaft, which is a component of a feeding rate adjusting unit in accordance with a first embodiment of the present invention.

FIG. 1 shows a body 1 of an arm of the sewing machine. A stopper receiver 1*a* is disposed in the body 1. A compressed spiral spring 5 is housed in the stopper receiver 1*a*. A feeding rate adjusting dial 3 is provided with a plurality of teeth disposed in the inner circumferential periphery of the dial 3. A stopper 6, inserted into the stopper receiver 1*a*, is urged by the compressed spiral spring 5 toward the feeding rate adjusting dial 3.

Figure 4:
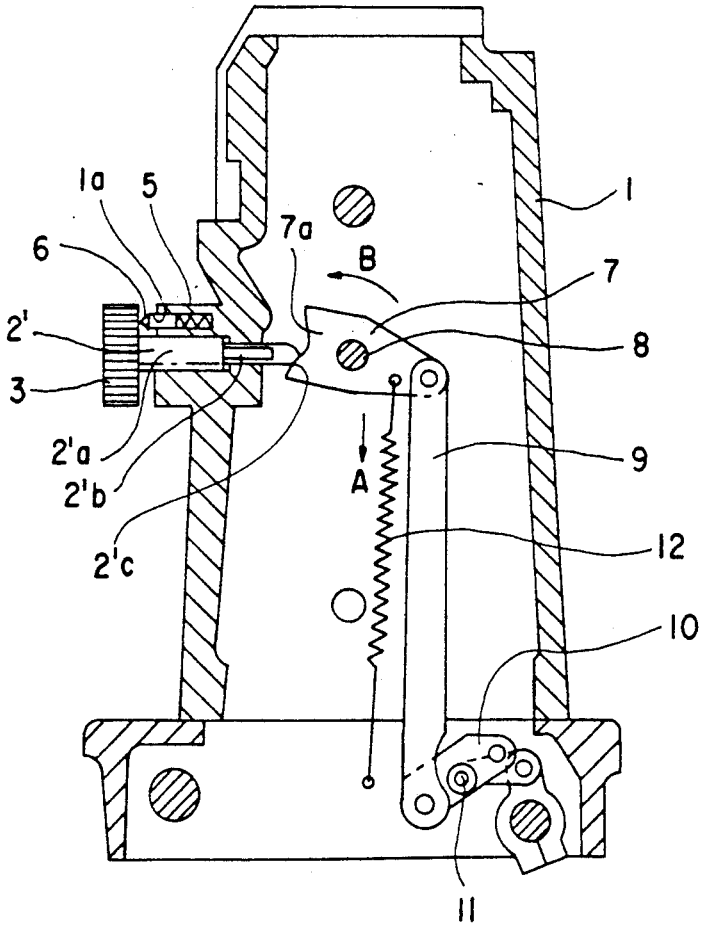
FIG. 4 is a cross sectional view of a prior art feeding rate adjusting unit.
Figure 5:
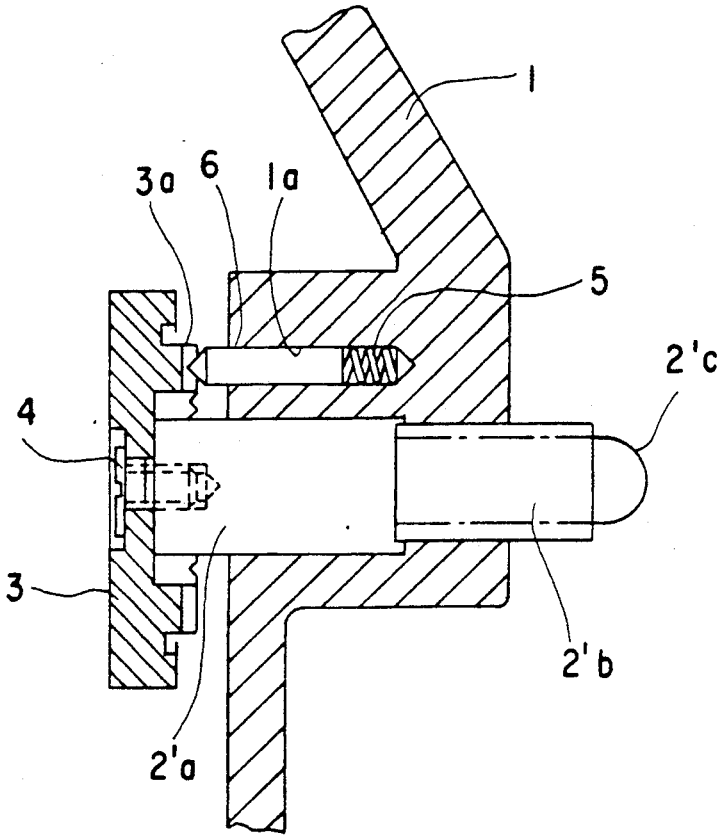
FIG. 5 is a cross sectional view of a prior art feeding rate adjusting shaft utilized in the unit shown in FIG. 4.

The feeding rate adjusting shaft 2 a dial fixing table 2*a* having an outer surface at one end thereof and at the other end is secured to the feeding rate adjusting dial 3 by a screw 4 and a projection having an annular groove at the other end thereof. A cam contact member 2*b* having a screw portion 2*b* at an outer peripheral surface thereof is screwed into body 1. Member 2*b* has a tip end surface 2*c* of hemispherical shape which is to be brought into contact with a cam surface 7*a* ( refer to FIG. 4) of a feeding adjusting cam 7. Surface 7*a* has a normal feeding control surface and a reverse feeding control surface. An elastic coupling 2*d* made of natural rubber or elastomer integrally connects the dial securing table 2*a* and the cam contact member 2*b*.

The dial fixing table 2*a* may have a screw portion to be screwed into a screw hole of the body 1 at an outer peripheral surface thereof. This portion can be replaced by screw portion 2*b*' of the cam contact member 2*b*.

The arrangements of cam shaft 8, link 9, the feeding adjusting table 10 and the tension spring 12 are identical with corresponding elements of the prior art feeding rate adjusting unit.

The operation of the feeding rate adjusting unit is described below.

When the feeding rate adjusting dial 3 is turned, the dial fixing table 2*a* and the cam contact member 2*b* connected to the dial fixing table 2*a* by the elastic coupling 2*d* screwed into the body 1 causes the tip end surface 2*c* of the cam contact member 2 to change position. The tip end surface 2*c* is moved into contact with the normal feeding control surface of the feeding adjusting cam (not shown). As a result, the stopper 6 urged by the compressed spring 5 is meshed with one of the plurality of teeth 3*a* defined in the inner circumference of the feeding rate adjusting dial 3 whereby the feeding rate adjusting unit can operate in the same manner as the prior art via the link connected to the feeding adjusting cam (not shown) while it is kept in the same position.

When the feeding direction of the sewn material is reversely operated for carrying out the backtacking operation, even if the reverse feeding control surface of the feeding cam (not shown) is forced into contact with the tip end surface of the cam contact member 2*b* of the feeding rate adjusting shaft, a shock of the impact contact is absorbed by the elastic coupling 2*d* whereby the sound of impact is greatly reduced when transmitted to the feeding rate adjusting dial 3.

Figure 2:
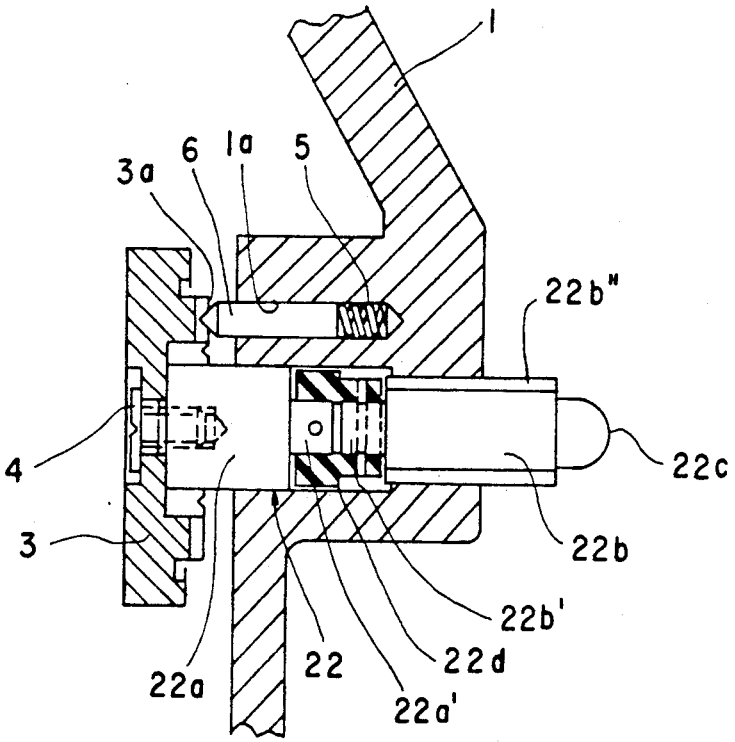
FIG. 2 is a cross sectional view of another embodiment of a feeding rate adjusting shaft.
Figure 3:
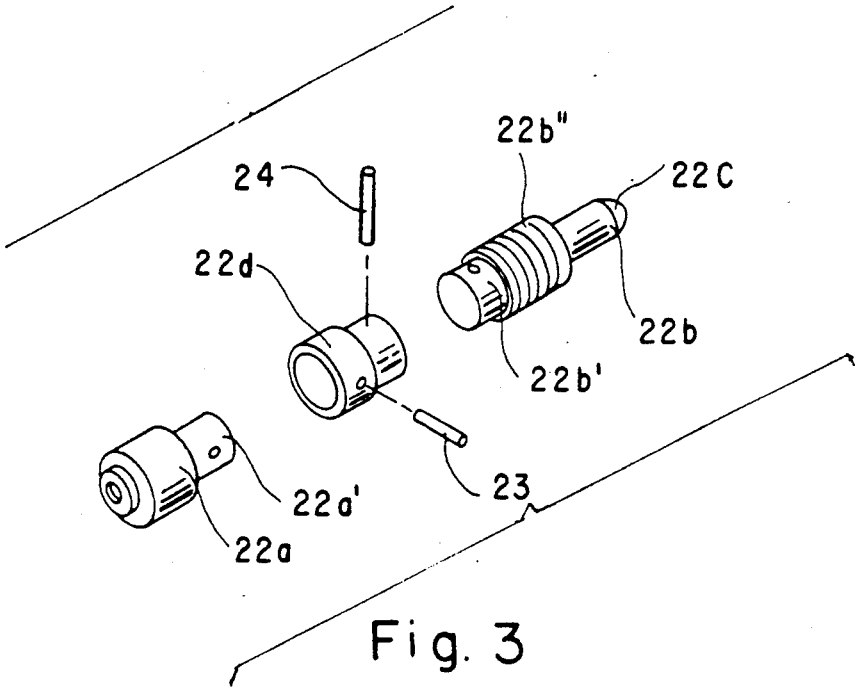
FIG. 3 is an exploded perspective view of the feeding rate adjusting shaft of FIG. 2.

A unit for adjusting the feeding rate of a sewing machine according to a second embodiment of the present invention is described with reference to FIGS. 2 and 3.

The elements of the second embodiment which are the same as those of the first embodiment are identified by the same number.

The feeding rate adjusting shaft 22 comprises a dial fixing table 22*a* having at an inner end thereof a projection 22*a*' provided with a pair of holes passing therethrough. A cam contact member 22*b* has at an inner end thereof a projection 22*b*' provided with a like pair of holes. A screw portion 22*b*" at the outer peripheral surface thereof is screwed into body 1 and a tip end surface 22*c* of hemispherical shape. An elastic coupling 22*d* made of a rubber or an elastomer elastically connects the dial fixing table 22*a* and cam contact member 22*b*. The elastic coupling 22*d* has two pairs of holes intersecting at right angles with each other.

The projections 22*a*', 22*b*' of the dial fixing tables 22*a* and the cam contact member 22*b* are respectively inserted into the elastic coupling 22*d* in such manner that the pair of through holes of both the projections 22*a*', 22*b*' are aligned respectively with those of the elastic couplings 22*d*. Thereafter connection pins 23, 24 are inserted into corresponding holes whereby the dial fixing table 22*a*, the cam contact member 22*b* and the elastic coupling 22*d* are integrally connected.

The second embodiment of the present invention has the same advantage as the first embodiment.

In the arrangement of the feeding rate adjusting unit according to the first and second embodiment of the present invention, the feeding rate adjusting shaft to be operated by the feeding rate adjusting dial is divided into two sections which are connected with each other by the elastic couplings. Hence if the cam surface of the feeding rate adjusting cam strikes the tip end surface of the feeding rate adjusting shaft, the shock caused by the strike is absorbed by the elastic coupling thereby preventing the metallic sound caused by the shock from being transmitted to the outside and prevents the feeding rate adjusting dial from vibrating. As a result, the metallic sound does not cause the operator to become nervous, thus improving the working efficiency. Furthermore, the feeding rate adjusting dial can be increased in size.

Although the invention has been described in its preferred form with a certain degree of particularity, it is to be understood that many variations and changes are possible in the invention without departing from the scope thereof.

What is claimed is:

1. A unit for adjusting a feeding rate of a sewing machine having a body of an arm, said unit comprising:

a feeding rate adjustment shaft screwed into the body, said shaft having first and second opposite ends, the first end terminating in a tip;

a feeding rate adjusting dial secured to the second end of the shaft and having an inner circumference spaced from and adjacent to the second end of the shaft, the dial having a plurality of teeth spaced apart and disposed along a circle on a surface of the inner circumference;

a stopper receiver bore disposed in the body spaced from and parallel to the shaft;

a stopper in said bore;

spring means disposed in said bore and engaging the stopper to cause the stopper to be in meshing position with one of said teeth;

a feeding adjusting table;

a link;

a feeding adjusting cam connected by the link to the feeding adjusting table;

the feeding adjusting cam having at one end a cam surface provided with a normal feeding control surface and a reverse feeding control surface, the tip end of the feeding rate adjusting shaft engaging the cam surface to thereby vary an inclination angle of the feeding adjusting table, to adjust the feeding rate in a normal or reverse feeding operation accordingly;

the feeding adjusting shaft including a dial securing table secured to the fixing adjusting dial and a cam contact member, one of said dial securing table and said contact member secured to said body; and an elastic member disposed between and coupled to the dial securing table and said cam contact member.

2. The unit of claim 1 wherein the dial securing table is secured to said body.

3. The unit of claim 1 wherein the cam contact member is secured to said body.

4. The unit of claim 3 wherein the dial securing table and the cam contact member each have holes aligned with corresponding holes in the elastic member and wherein connection pins are disposed in the aligned holes to integrally connect the dial securing table, the cam contact member and the elastic member.

* * * * *